US005631683A

United States Patent [19]

Nishioka et al.

[11] Patent Number: 5,631,683

[45] Date of Patent: May 20, 1997

[54] INK JET CARTRIDGE AND PRINTER USING IT

[75] Inventors: Atushi Nishioka; Yukihiro Hanaoka; Shigeo Sugimura; Tsutomu Yamazaki; Kazuhiko Sato, all of Suwa, Japan

[73] Assignee: Seiko Epson Corporation, Tokyo, Japan

[21] Appl. No.: 362,612

[22] Filed: Dec. 22, 1994

[30] Foreign Application Priority Data

Dec. 28, 1993 [JP] Japan ..... 5-335169
Dec. 20, 1994 [JP] Japan ..... 6-316987

[51] Int. Cl.[6] ..... B41J 2/175

[52] U.S. Cl. ..... 347/87

[58] Field of Search ..... 347/86, 87, 85, 347/35; 222/214

[56] References Cited

U.S. PATENT DOCUMENTS

| | | | |
|---|---|---|---|
| 4,599,625 | 7/1986 | Terasawa et al. | 346/140 |
| 4,785,314 | 11/1988 | Terasawa et al. | 346/140 |
| 4,967,209 | 10/1990 | Hasegawa et al. | 346/140 |
| 5,040,001 | 8/1991 | Dunn et al. | 346/140 |
| 5,359,356 | 10/1994 | Ecklund | 347/86 |

FOREIGN PATENT DOCUMENTS

| | | |
|---|---|---|
| 224550 | 11/1985 | Japan . |
| 249757 | 11/1986 | Japan . |
| 274555 | 11/1988 | Japan . |
| 52782 | 8/1992 | Japan . |
| 232756 | 8/1992 | Japan . |
| 536689 | 9/1993 | Japan . |

*Primary Examiner*—Benjamin R. Fuller
*Assistant Examiner*—Judy Nguyen
*Attorney, Agent, or Firm*—Eric B. Janofsky

[57] ABSTRACT

An inkjet cartridge is provided in which by applying an appropriate initial pressure to an ink reservoir or sack at the start of printing does not excessively increase the pressure in an ink reservoir or sack when the remaining ink level is high, and enables effective use of the remaining ink when the remaining ink level is low. The inkjet cartridge comprises an ink reservoir for storing the recording ink, a circuit element for ejecting ink supplied from ink reservoir according to the display data from a host processor to be recorded. A head case and an ink supply case accommodating the ink reservoir. A thick-wall region of the ink reservoir is pressed by a pressure rod via a through-hole. A guide is provided to push the thick-wall region to one side of the ink reservoir is disposed in the top portion of the case or the guide is provided around the thick-wall region of the ink reservoir.

9 Claims, 9 Drawing Sheets

INK JET CARTRIDGE AND PRINTER USING IT

BACKGROUND OF THE INVENTION

1. Field of the Invention

This invention relates generally to an ink jet cartridge mounted in an ink jet printer for recording to a recording medium by means of ejecting ink from a recording head. The present invention particularly relates to an expulsion means for purging defective ink or bubbles associated with ink ejection problems in the ink channel.

2. Description of the Related Art

In general, an inkjet cartridge comprises a recording head unit, an ink container, or reservoir, for example a sack connecting the ink container and recording head. This ink container is typically made from a rubberized material, and under certain circumstances is unable to expel or eject sufficient ink for normal printing. This can occur when, for example an extended time the ink jet cartridge is not used for printing and the viscosity of ink around the nozzle increases from the evaporation of moisture in the ink, or bubbles form in the ink passage due to a sharp impact, such as when the cartridge is accidentally dropped.

As a means of restoring an ink jet cartridge which is unable to print normally to a condition enabling normal printing, a small hole is provided in the back of the cartridge, and the ink container or sack inside the cartridge is pressurized by a pressurizing needle provided in the printer and inserted through this small hole, thereby purging any high viscosity ink around the nozzle or bubbles in the ink passage. This type of operation is referred to as "priming" below. This type of device is discussed in, for example, JP-A-1986-249757 and JP-A-1988-274555.

Another type of recovery means, described in JP-B-1992-52782, comprises an ink tank and a priming button on a means securing the ink tank to the carriage. This ink tank provides a freely deformable ink sack for storing the ink inside the cartridge case; provides a low strength member in the component parts of the case; and provides a lever for rupturing the low strength member of the case and rotating to a position pressurizing the ink sack. The button forms a lever for rupturing the low strength member of said case, and presses the lever to prime the cartridge.

However, with the means described in JP-A-1988-274555, the back of the ink sack is pressed using a pressurizing needle. When the mount of ink remaining in the tank is great, excessive pressure may be applied, and the ink container may puncture, forming a hole. When the amount of ink remaining in the tank is low, however, the needle contacts the wall covering the opening of the ink container, and it is not possible to apply sufficient pressure to the remaining ink to adequately prime the cartridge. As a result, it is not possible to restore normal printing when the ink level is low. In addition, depending on how and where pressure is applied to the ink sack for priming, the ink sack will collapse in different ways. When the cartridge is then primed the ink sack collapses improperly, an inappropriate high negative pressure (pressure acting to return ink from the recording head to the ink sack) may remain in the ink container, possibly making it impossible to supply ink to the recording head.

With the means described in JP-B-1992-52782, there is a tendency for form burrs on the ruptured surface of the lever which may damage the ink sack. In addition, when there is little ink remaining in the ink sack, the lever must be rotated a sufficient distance in order to sufficiently prime the cartridge. This concentrates the bending stress on the pivot point of the lever, however, and can potentially break the lever. It is also necessary to increase the operating stroke of the button pressing the lever in order to rotate the lever a sufficient distance, and this factor alone increases the required size of the recovery means.

OBJECTS OF THE INVENTION

It is an object of the present invention to provided an inkjet cartridge which obviates the aforementioned problems.

It is another object of the present invention to provide an ink jet cartridge whereby the printing operation can be restored by a reliable priming operation without applying excessive pressure when the remaining ink level is high, without damaging the ink container, and even when the remaining ink level is low, thereby enabling effective use of the remaining ink, and reliably and easily purging air bubbles and defective ink.

SUMMARY OF THE INVENTION

In accordance with an aspect of to the present invention, an inkjet cartridge comprises an ink sack with one end open and one end closed for storing the recording ink or marking fluid, a recording head having nozzles for ejecting ink in accordance with recording data, a capillary tube, one end of which is connected to the open end of the ink sack and the other end connected to the recording head so that the ink stored in the ink sack is supplied to the nozzles, and a housing for holding the ink sack and recording head. This ink jet cartridge is further comprised by a through-hole provided in a side of the housing for applying pressure to the ink sack by means of a pressure rod against one part of the ink sack; a thick-wall region in the side of the ink sack for contacting the end of the pressure rod; and a guide means provided around the thick-wall region or at the through-hole for guiding the end of the pressure rod to the thick-wall region.

In accordance with another aspect of the present invention, the thick-wall region of the ink sack is provided with a thickness two to ten times that of the thin-wall part of the ink sack; is provided covering from approximately one-quarter to one-half the circumference of the ink sack; and is provided at the bottom of the ink sack. In addition, the cross-sectional shape of the ink sack stored in the housing is preferably flat and long relative to the direction of movement of the carriage on which the ink jet cartridge is mounted and which transports said cartridge. The force exerted by the pressure rod preferably has a main component in a direction parallel the axis of easy deformation. This also prevents the ink sack from being deformed in response to impacts which may occur each time the carriage reaches an end of its reciprocating movement.

The preferred embodiment further provides around the nozzles a channel for stopping a predetermined quantity of ink, which is expelled by pressure from the pressure rod; this predetermined quantity is more specifically the quantity necessary and sufficient to purge the defective ink in the ink passage of the ink jet cartridge.

The operation of an ink jet cartridge thus comprised is described below with reference to FIGS. 4, 6, 8, and 10.

As shown in FIGS. 4 and 10, thick-wall region 33 provided in the side of ink sack 30 is pressed to one side of ink sack 30 by means of pressure rod 63 inserted through through-hole 62 by means of this configuration. The guide member is formed by providing wall 35 around the surface pressed by pressure rod 63, or by forming through-hole 62 to restrict the insertion direction of pressure rod 63. This guide member prevents the tip of pressure rod 63 from pressing against any part of ink sack 30 other than the predetermined thick-wall region, and thereby prevents damage to ink sack 30 by pressure rod 63.

Packing member 32, which is the edge of the open end of ink sack 30, is secured to the rigid housing, and the thickness of the area around thick-wall region 33 is thinner than that of thick-wall region 33. As a result, when ink sack 30 is pushed in by pressure rod 63, thick-wall region 33 against which pressure rod 63 presses moves in a roughly arc-shaped path centered on the bottom of packing member 32 as shown in FIGS. 6 and 8, and it is primarily the thin-walled part of ink sack 30 that is deformed. In addition, because both easily deformed and not-easily deformed areas are provided in ink sack 30, the thin-walled part of ink sack 30 deforms greatly with virtually no deformation of thick-wall region 33 when the ink jet cartridge is primed after ink has been consumed and very little ink remains, and ink sack 30 deforms according to a constant deformation pattern. As a result, a constant negative pressure is maintained relative to a given remaining ink level, and the negative pressure inside ink sack 30 does not change greatly because the shape of ink sack 30 after priming returns to essentially the same shape as before priming.

In addition, when the remaining ink level is low, the remaining ink tends to pool at the open end of ink sack 30. As shown in FIG. 8, however, because thick-wall region 33 is pressed to move in an arc centered on the bottom side of packing member 32, sufficient pressure can be applied to the remaining ink to reliably purge any defective ink even when the remaining ink level is low.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference number denote like parts.

DESCRIPTION OF THE PREFERRED EMBODIMENTS

Reference is now made to the accompanying figures.

Figure 1:
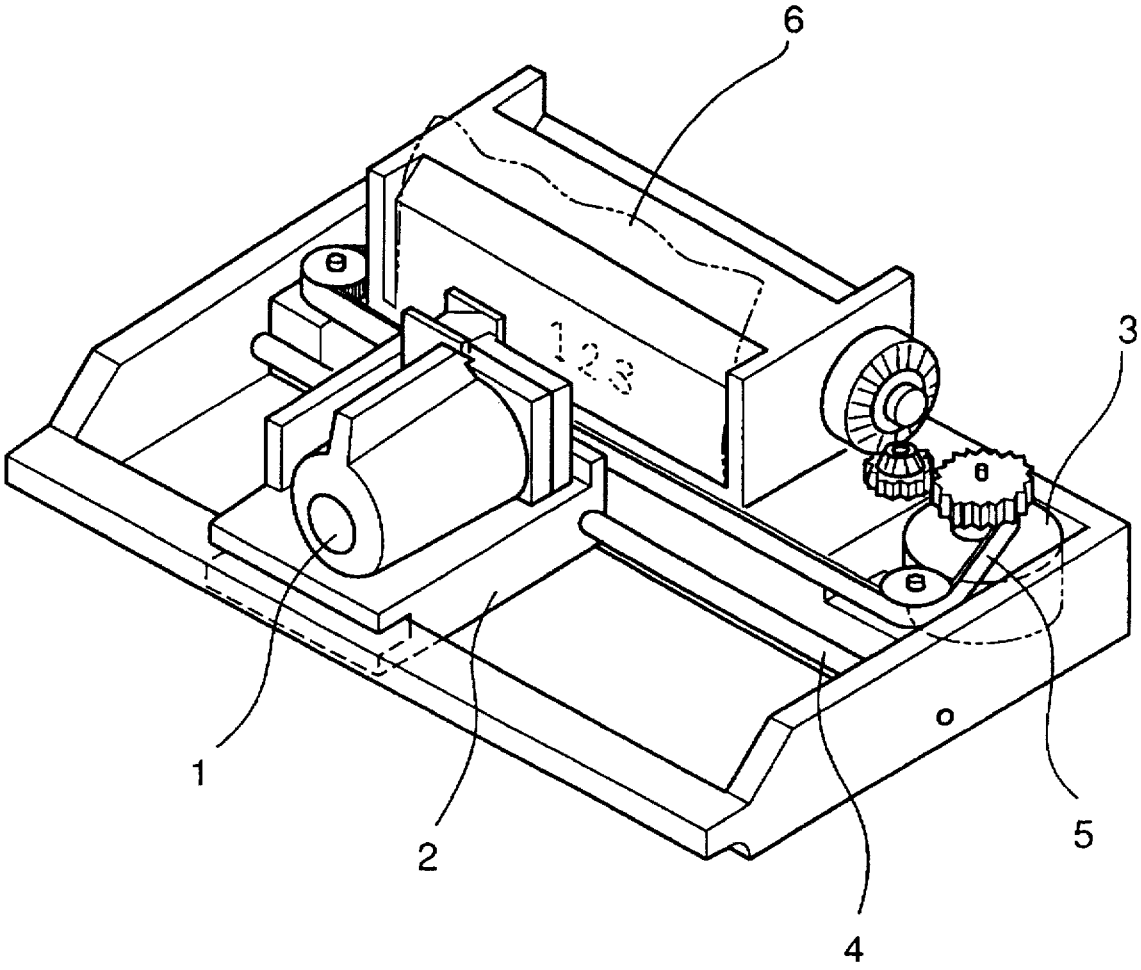
FIG. 1 is a perspective view of an ink jet printer provided with an ink jet cartridge in accordance with a preferred embodiment of the present invention.

FIG. 1 is a perspective view of an ink jet printer provided with an ink jet cartridge according to the preferred embodiment of the present invention. As shown in FIG. 1, ink jet cartridge 1 is mounted on a carriage 2, which is driven via belt 5 by motor 3 along guide rod 4 in the recording direction of recording medium 6. Circuit element 55 is connected to a host processor (not shown) via flexible printed circuit 56. Circuit element 55 maybe implemented as an integrated circuit (see FIG. 2) is provided at the front of ink jet cartridge 1. Circuit element 55 comprises nozzles 57 from which the ink is ejected based on the recording signal from the host processor to print the desired text or graphic elements to recording medium 6. As will be appreciated by one of ordinary skill in the art, the printer described above is for illustration purposes only and other types of printers may easily employ the inkjet cartridge in accordance with the present invention.

An ink jet cartridge according to the preferred embodiment of the present invention is described in detail below with reference to FIGS. 2–8.

Figure 2:
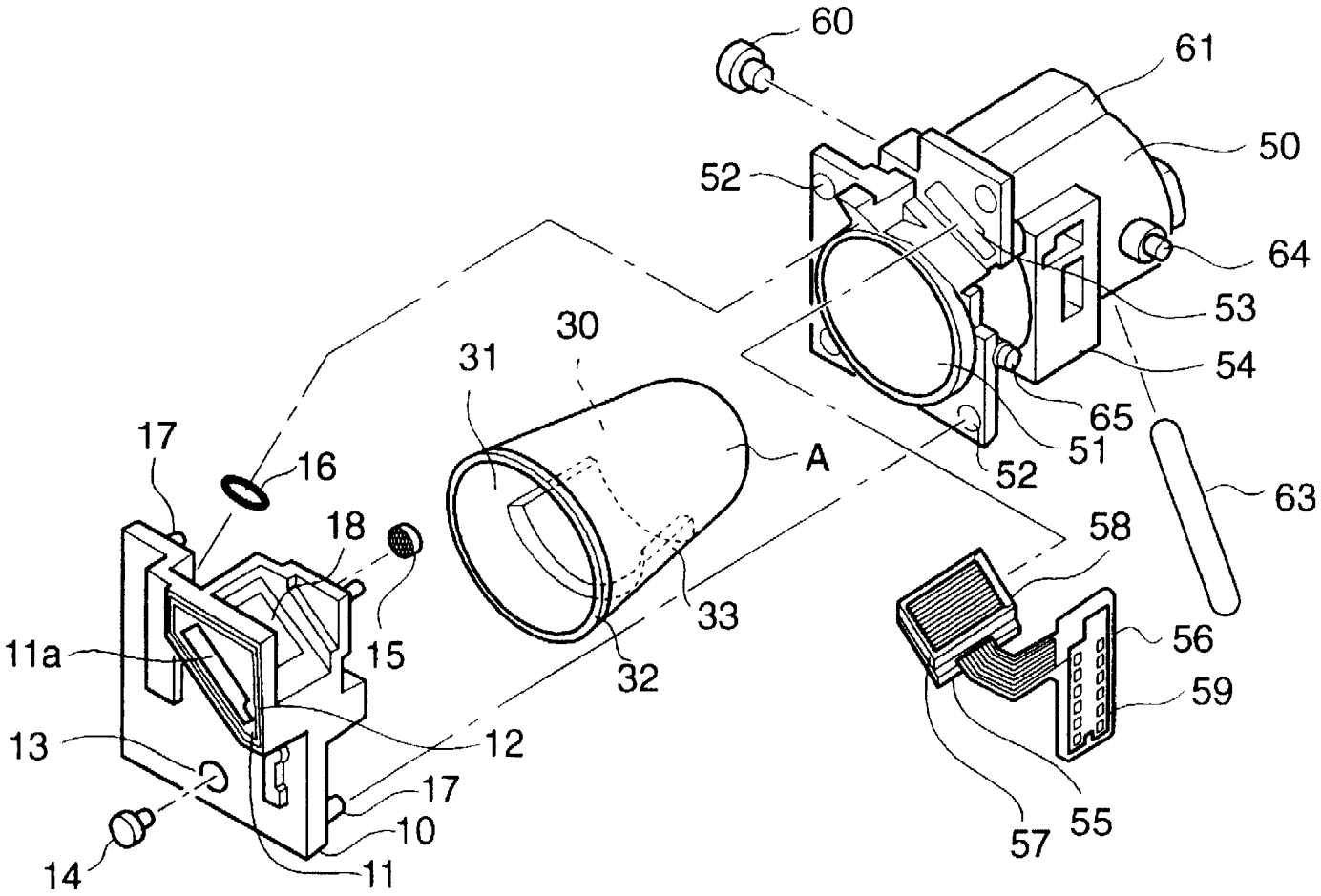
FIG. 2 is an exploded view showing the construction of the preferred ink jet cartridge of FIG. 1.

FIG. 2 is an exploded perspective view showing the construction of the preferred ink jet cartridge, which comprises head case 10, an ink reservoir or sack 30, and an ink supply case 50. Head case 10 is preferably made from polyarylate (PAR), polysulfone (PSF), polycarbonate (PC), or a similar transparent material. When circuit element 55, which is described further below, is provided at the right front shoulder of head case 10, nozzle plate member 11 is provided in this area with opening 11*a* through which nozzles 57 are exposed, and ink stopping ring 12 is provided around this area.

When inkjet cartridge I is primed, ink stopping ring 12 stops and holds the ink purged from nozzles 57 by means of the surface tension of the ink, and the purged ink is held inside this ink stopping ring 12 in a shape sustaining the surface tension. As a result, ink stopping ring 12 provides a guide to the amount of ink purged by the priming operation. By controlling the priming operation referenced to this ink quantity guide, unnecessary loss of ink from over-priming, and ink jet cartridge recovery failures (failure to completely purge defective ink or air bubbles from the nozzles) resulting from insufficient priming can be prevented. Note that the amount of ink purged by the priming operation based on this guide is set to approximately 0.02–0.05 cc in this embodiment.

Ink filling port 13 is provided at the bottom front of head case 10; ink filling port 13 is closed or plugged by press-fit plug 14 at all times other than when ink is being loaded into the ink jet cartridge. To prevent foreign matter such as dirt, dust, etc. from being introduced to the ink when plug 14 is inserted, plug 14 is preferably made from a nylon material in this embodiment, but may alternatively be a polyimide or other soft resin material, or a metallic ball member. Note that plug 60 in ink supply case 50 and described below may be made of similar materials.

At the rear portion of head case 10, an ink supply tube is formed, the inlet of which is thermally fused to filter 15. Filter 15 is preferably implemented as a twill weave stainless steel mesh filter. The ink supply tube formed at the back of head case 10 is connected to the ink supply tube formed in ink supply case 50 by O-ring 16. More specifically, O-ring 16 is sandwiched between head case 10 and ink supply case 50, and thus forms part of the completed ink supply tube. Also formed on the back of head case 10 are plural pins 17 for connecting head case 10 to ink supply case 50.

Ink sack 30 is made of a flexible material, for example, from a butyl rubber material, and comprises at one end a round opening 31 as shown in FIG. 2. The perimeter of opening 31 is packing or gasket member 32. Packing member 32 is sandwiched between head case 10 and ink supply case 50 in a long flat or elliptical shape with the long axis oriented in the direction of carriage travel, and thus forms a seal between head case 10 and ink supply case 50. A thick-wall region 33 is provided on the bottom of ink sack 30.

Similarly to head case 10, ink supply case 50 is preferably manufactured from polyarylate (PAR), polysulfone (PSF), polycarbonate (PC), or a similar transparent material. On the side of ink supply case 50 opposing head case 10 is formed opening 51; ink sack 30 is housed in opening 51. Coupling holes 52 are also formed on this side of ink supply case 50. Pins 17 of head case 10 are pressed into coupling holes 52 to secure head case 10 and ink supply case 50. Also on the side of ink supply case 50 opposing head case 10 is formed opening 53 in the same shape as opening 11*a* of nozzle plate member 11 in head case 10. On the side of ink supply case 50 is formed head FPC (flexible printed circuit) holder 54.

Circuit element 55 and head FPC 56 are housed in opening 53 and head FPC holder 54. Nozzles 57 are formed at one end of head chip 55, and ink supply port 58 is formed at the other end. Circuit element 55 is also placed in space 18 formed in the back of head case 10, nozzles 57 are inserted to opening 11*a* of nozzle plate member 11 in head case 10, and the perimeter is bonded with adhesive.

Ink supply port 58 is inserted to opening 53 in ink supply case 50, and the perimeter is bonded and sealed with adhesive. Head FPC 56 is preferably made from a polyimide resin and is electrically connected to circuit element 55 by, for example, an anistropic conductive film. Contact member 59 is secured to head FPC holder 54 of ink supply case 50 by, for example, bonding with double-sided tape.

An opening (not shown in the figure) is provided in ink supply case 50 on the side opposite head FPC holder 54; this opening is plugged by press-fit plug 60. A projecting handle 61 is also provided on the top of ink supply case 50. On the bottom of ink supply case 50 is provided a through-hole (also not shown). Pressure rod 63 is inserted through this through-hole, and is pushed against thick-wall region 33 of ink sack 30 at the start of the initial printing operation and when printing problems occur so as to apply pressure to the ink in ink sack 30. Positioning pins 64 and 65 for positioning to the carriage (not shown in the figure) are provided on the head FPC holder 54 side of ink supply case 50; positioning pins 64 and 65 are used as the reference position when installing the ink jet cartridge to the carriage.

As described above, the ink jet cartridge of the invention is made from primarily transparent materials, thus enabling the operator to see inside the cartridge to roughly determine the amount of ink remaining and thereby determine whether printing should be possible.

Figure 3:
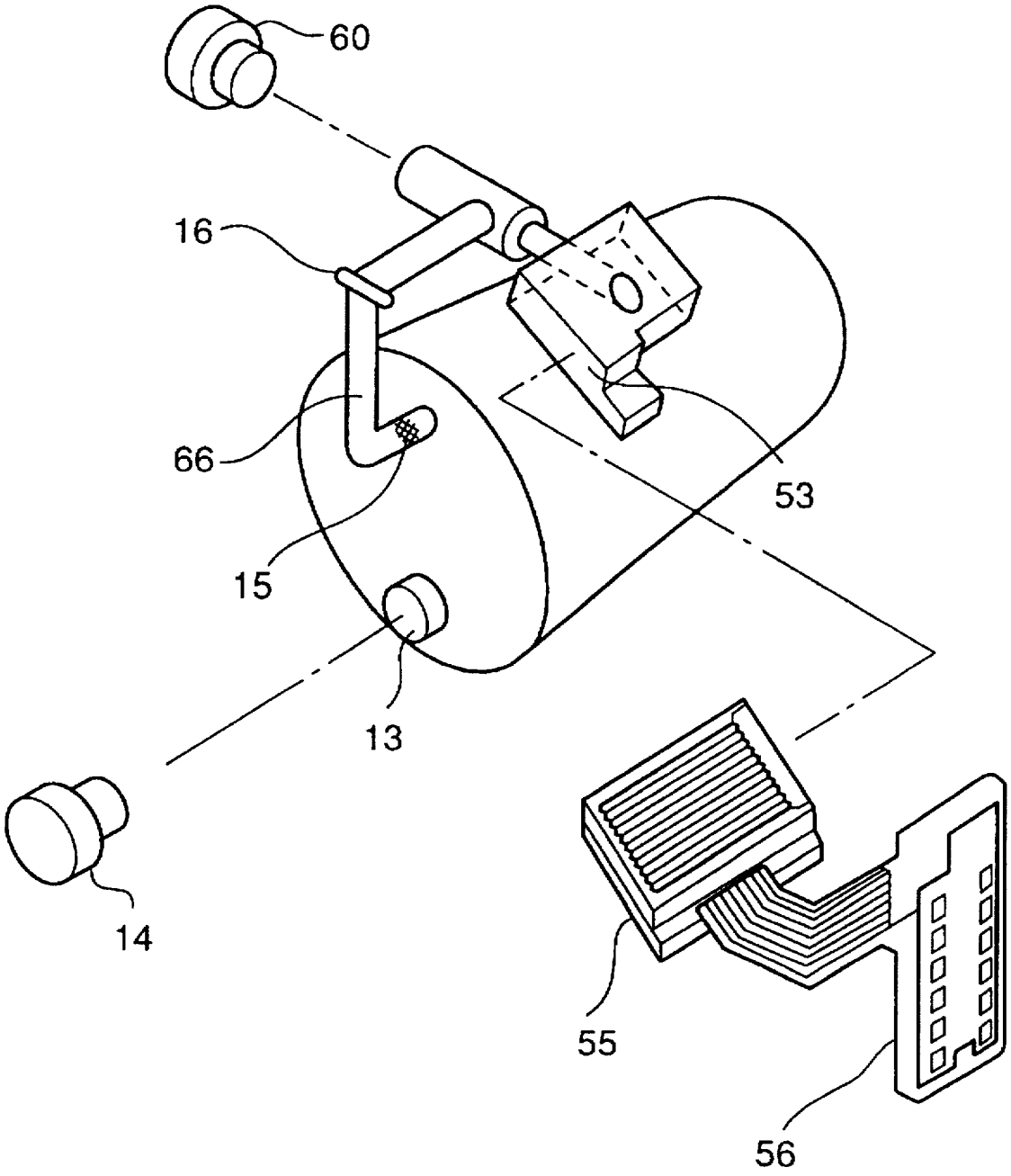
FIG. 3 is an exploded view of the ink supply tube of the ink jet cartridge shown in FIG. 2.

FIG. 3 is a perspective view focusing on the ink supply tube of the ink jet cartridge shown in FIG. 2. As shown in the figure, ink supply tube 66 is formed in head case 10 and ink supply case 50 covering ink sack 30. The rigidity of ink supply tube 66 is therefore high, and when an external impact is applied, the compliance of the flow channel is low and abnormal pressure is not created in the flow channel, making it possible to prevent air from entering nozzles, thus preventing missing dots from being printed. This configuration also makes it possible to achieve a smaller ink jet cartridge because the ink supply channel is formed by assembling in head case 10 to ink supply case 50 and it is not necessary to separately provide other ink supply channel.

Figure 4:
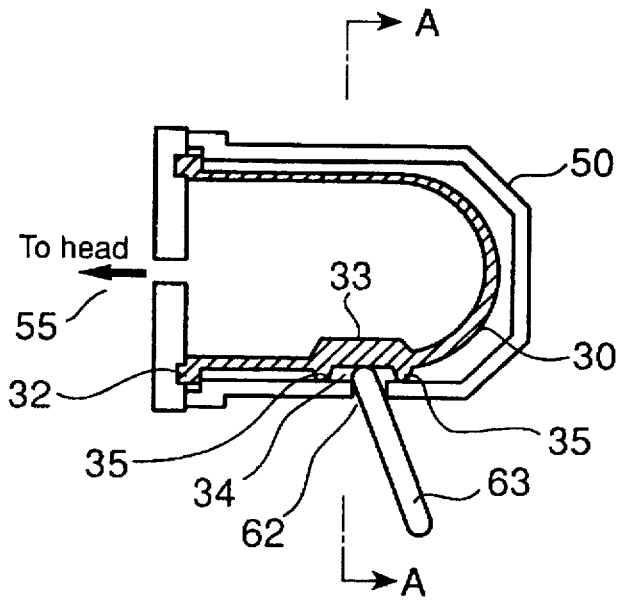
FIG. 4 is a cross-sectional view of an ink reservoir in the ink jet cartridge of the embodiment shown in FIG. 2.
Figure 5:
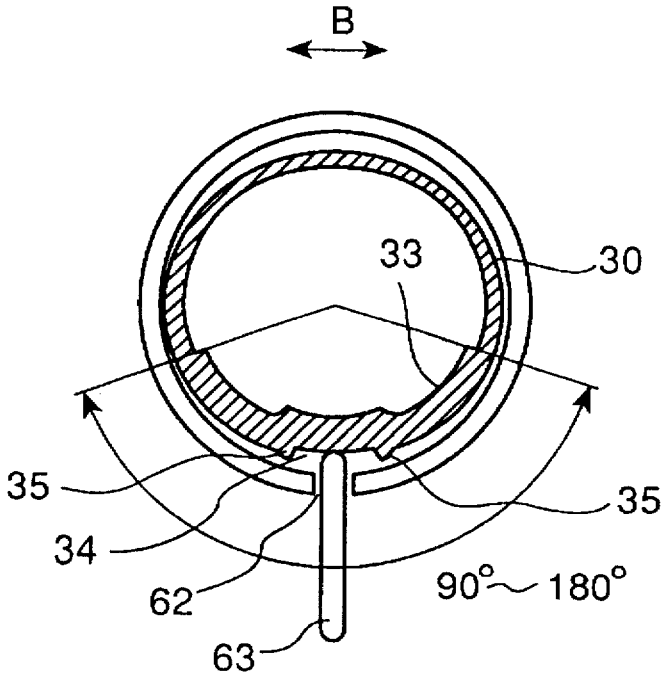
FIG. 5 is a cross-sectional view taken along line A—A in FIG. 4.

FIGS. 4 and 5 are cross-sectional views of ink sack 30 in the ink jet cartridge of the embodiment shown in FIG. 2, FIG. 5 being a cross-sectional view taken along line A—A in FIG. 4. As shown in the figures, thick-wall region 33 of ink sack 30 contacted by pressure rod 63 occupies approximately one-third the circumferential length of ink sack 30, and is provided in the middle on the bottom side of ink sack 30. Thick-wall region 33 also spans a 90°–180° band on the circumference of ink sack 30, and is preferably 1–3 mm thick; the thin-walled part of ink sack 30 is preferably 0.3–0.5 mm thick.

The thickness of thick-wall region 33 is preferably 2–10 times the thickness of the thin-walled part. This thickness range is specified because the thickness required to prevent damage to the ink sack by the relatively high pressure created when the ink jet cartridge is new and the remaining ink level is high is two or more times the thickness of the thin-walled part of the ink sack; and when the thickness is ten or more times the thickness of the thin-walled part, the negative pressure characteristic of ink sack 30 and the deformability of ink sack 30 as ink is consumed are adversely affected, i.e., a high negative pressure occurs particularly when the remaining ink level is low, this prevents the supply of ink to the recording head, and printing is thus disabled.

It is also preferable that thick-wall region 33 covers approximately one-fourth to one-half the circumference of ink sack 30. This is because if thick-wall region 33 covers less than one-fourth the circumference, ink cannot be sufficiently purged by the priming operation when the remaining ink level is low; and if it covers more than one-half, the rigidity of ink sack 30 increases and the negative pressure that occurs increases, thus preventing the supply of ink to the recording head and disabling printing.

Wall 35 is provided around the surface of thick-wall region 33 against which pressure rod 63 pushes, thus forming guide member 34; guide member 34 assures that thick-wall region 33 is pressed by pressure rod 63 during the priming operation. Guide member 34 thus also prevents the tip of pressure rod 63 from pushing against any part of ink sack 30 other than thick-wall region 33, and thereby prevents any damage to ink sack 30 by pressure rod 63. Note, also, that the thickness of thick-wall region 33 is to the inside of ink sack 30. This is because the gap between thick-wall region 33, or more specifically the pressed area, and ink supply case 50 should be as small as possible. Ink sack 30 is also a large, flattened shape of which the larger dimension B is aligned with the direction of carriage movement and perpendicular to the direction of a main force component applied by pressure rod 63. As a result, a controlled deformation of ink sack 30 during the priming operation by pressure rod 63 will be obtained with pressure rod 63 working in conjunction with thick-wall region 33 as described below.

Figure 6:
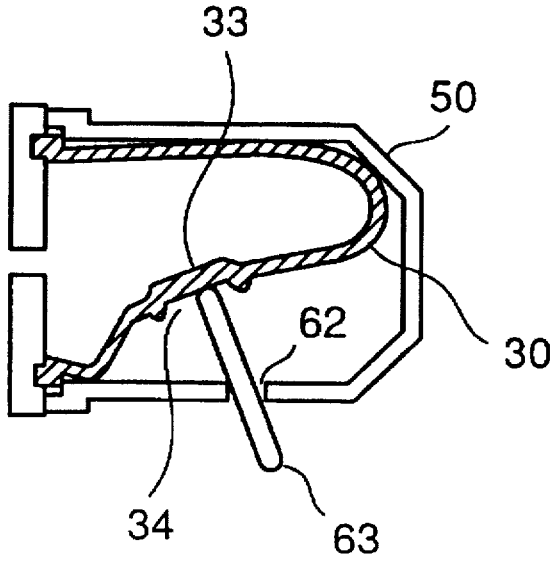
FIG. 6 is a side cross-sectional illustrating the priming operation of the embodiment shown in FIG. 2 when the remaining ink level of the ink reservoir is high.
Figure 7:
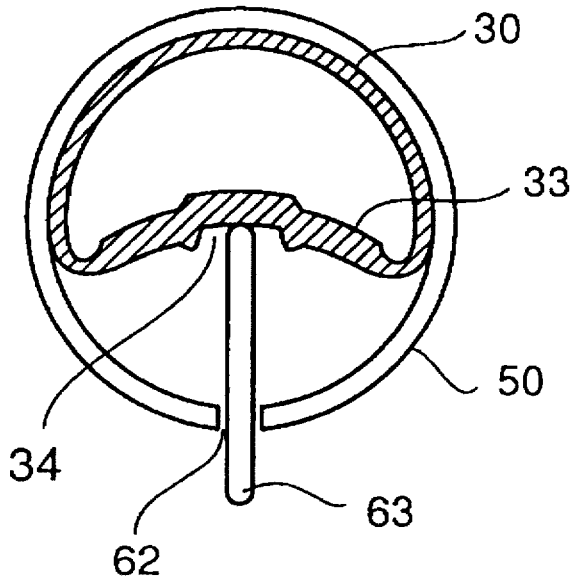
FIG. 7 is a front cross-sectional view illustrating the priming operation of the embodiment shown in FIG. 2 when the remaining ink level of the ink reservoir is high.

Priming operation when the remaining ink level is high is described below with reference to FIGS. 6 and 7. Packing member 32, which is the edge of the open end of the ink sack, is held securely by the rigid case and the thin-walled part surrounding thick-wall region 33 is deformed more easily than the thick-wall region. According to these structure, when pressure rod 63 is inserted to through-hole 62 and pushes into ink sack 30, thick-wall region 33 pressed by pressure rod 63 moves toward one end of ink sack 30 in an arc centered on the bottom side of packing member 32 as shown in FIG. 6. Because the surface of thick-wall region 33 is greater than the tip of pressure rod 63, assuming a certain force is exerted by the pressure rod, the resulting deformation of the ink sack will be smaller as would be if there were no thick-wall region. In other words, the thick-wall region functions as a kind of bumper avoiding the pressure is held low, and the sudden ejecting of ink from nozzles 57 can be prevented. Moreover, because guide member 34 guiding the tip of pressure rod 63 to thick-wall region 33 is also provided in ink sack 30, pressure rod 63 cannot slip into the thin-walled part of ink sack 30 as it is pushed in, and there is therefore no chance of ink sack 30 being punctured.

Figure 8:
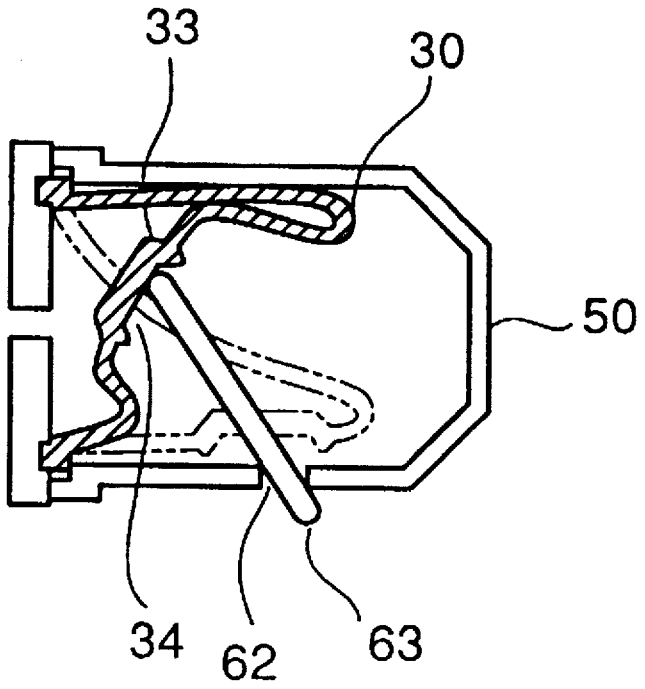
FIG. 8 is a side cross-sectional view illustrating the priming operation of the embodiment shown in FIG. 2 when the remaining ink level of the ink reservoir is low.

FIG. 8 illustrates the operation when the remaining ink level is low. The break line in FIG. 8 shows the shape of the ink sack when the priming operation is not being executed, and the solid line shows the shape of the ink sack during the priming operation.

When the remaining ink level is low, most of the ink remains near the opening of ink sack 30. By thus pressing guide member 34 of thick-wall region 33 toward the ink sack opening, thick-wall region 33 moves in an arc centered on the bottom side of packing member 32 as shown in FIG. 8, and sufficient pressure can be applied inside ink sack 30 to purge any defective ink even when the remaining ink level is low.

To prevent ink from leaking from nozzles 57 during printer standby states when no printing occurs and when the ink jet cartridge is removed from the printer, it is necessary to constantly apply pressure (negative pressure) acting to return ink from the recording head into the ink flow channel formed inside the cartridge. This negative pressure is obtained in the present invention by the spring characteristic (shape recovery characteristic) of ink sack 30. (When the ink sack is filled with ink the ink sack is held deformed, for instance by inserting an adjusting rod through the hole 62 and pressing it against the thick-wall region. When filling is completed the adjusting rod removed, a negative pressure builds up because of the spring characteristic of the ink sack.) Because easily deformed and not-easily deformed areas are actively provided in ink sack 30 as described above, ink sack 30 deforms according to a constant deformation pattern, even when the ink level drops as ink is consumed, with virtually no deformation of thick-wall region 33 but significant deformation of the thin-walled part as shown by the break line. In addition, because a constant negative pressure is maintained for a given ink level, and the shape of ink sack 30 after priming recovers to essentially the same shape as before priming (the shape indicated by the break line in FIG. 8), the negative pressure inside ink sack 30 does not change greatly. As a result, the negative pressure will not become high enough to prevent the supply of ink to the recording head, and printing will therefore not become disabled. Note that, as described above, ink sack 30 is more easily deformed vertically than in the direction of carriage travel because ink sack 30 is a flattened shape with the large dimension in the direction B of carriage travel. The reason this shape is used is similar to the reason for providing thick-wall region 33: actively providing the ink sack with an easily deformed axis and a not-easily deformed axis helps to keep the negative pressure inside ink sack 30 as constant as possible.

It is to be noted that while the embodiment shown in FIG. 2 above has been described with thick-wall region 33 provided in ink sack 30, it is also possible to use a constant wall thickness in ink sack 30 and bond a separate, relatively rigid member to ink sack 30 in the area of thick-wall region 33.

An alternative embodiment of an ink jet cartridge according to the present invention is described below with reference to FIGS. 9–12.

Figure 9:
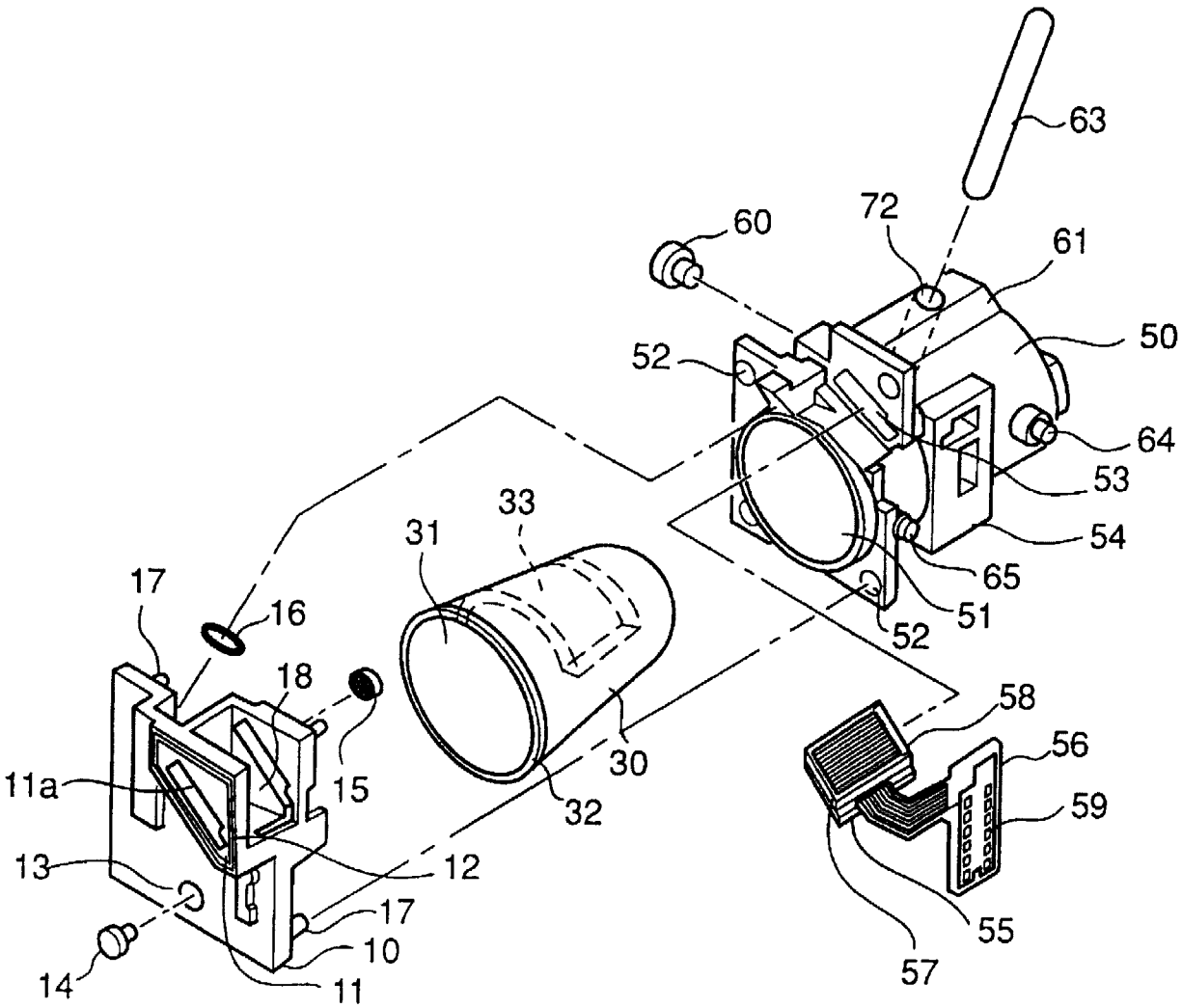
FIG. 9 is a perspective view of an ink jet printer provided with an ink jet cartridge in accordance with an alternative embodiment of the present invention.
Figure 10:
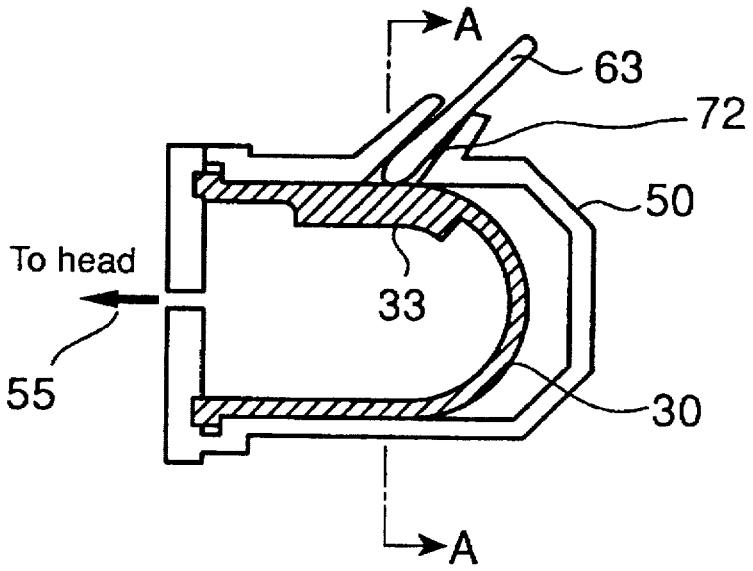
FIG. 10 is a cross-sectional view of the ink reservoir in the ink jet cartridge of the embodiment shown in FIG. 9.
Figure 11:
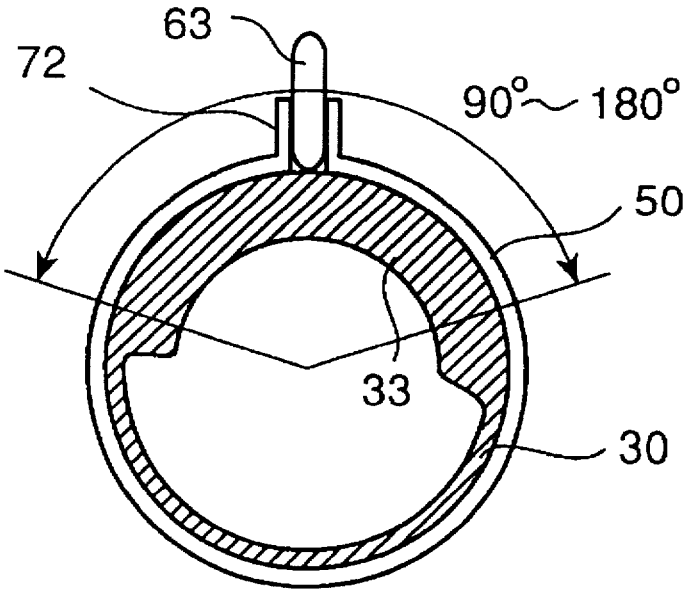
FIG. 11 is a cross-sectional view taken along line at A—A in FIG. 10.

FIG. 9 is a perspective view of the structure of an ink jet cartridge according to this alternative embodiment; and FIGS. 10 and 11 are cross-sectional views of ink sack 30 in the ink jet cartridge of the embodiment shown in FIG. 9, FIG. 11 being a cross-sectional views taken along line A—A in FIG. 10.

As described in the first embodiment, projecting handle 61 is provided in the top of ink supply case 50. Guide hole 72 passing through handle 61 is provided at an angle of, for example, approximately 45 degrees. Pressure rod 63 is inserted through guide hole 62, and is pushed down against thick-wall region 33 of ink sack 30 at the start of the initial printing operation and when it is necessary to purge defective ink, air bubbles, etc. to apply pressure to the ink in ink sack 30.

As also shown in FIGS. 10 and 11, thick-wall region 33 occupies approximately one-third the total length of ink sack 30 in the middle on the top side of ink sack 30; spans preferably a 90°–180° band on the circumference of ink sack 30; and preferably is 1–3 mm thick with the thickness provided to the interior side of ink sack 30. Other aspects of the structure are as described in the first embodiment above, and a further description is therefore omitted below.

Figure 12:
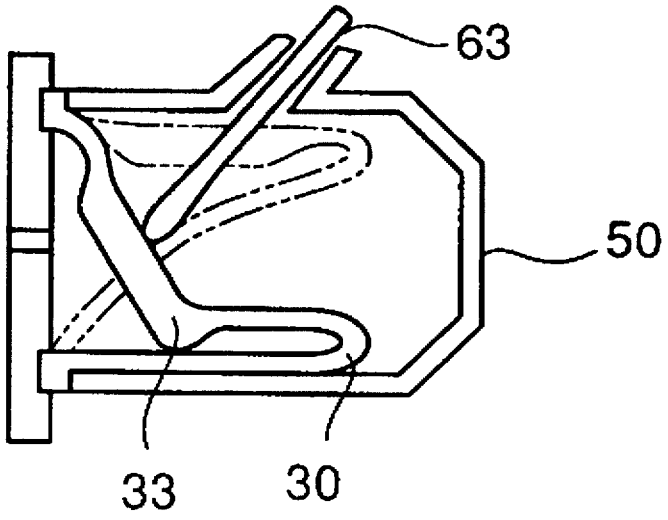
FIG. 12 is a side cross-sectional view illustrating the priming operation of the embodiment shown in FIG. 9 when the remaining ink level of the ink reservoir is low.

FIG. 12 is used below to describe the operation when the remaining ink level is low.

When the remaining ink level is low, more ink remains near the opening of ink sack 30. As a result, by pressing thick-wall region 33 toward the ink sack opening, the pressure inside ink sack 30 can be increased even when the remaining ink level is low. Because the direction in which pressure is applied to ink sack 30 by pressure rod 63 is restricted and guided by guide hole 62, there is no variation in the direction in which pressure is applied, and the cartridge can be reliably primed.

It is to be noted that while the above embodiments have been described with reference to an ink cartridge housing an ink sack having a thick-wall region provided on either the top or bottom of the ink sack, the present invention shall not be so limited, and the thick-wall region and through-hole for inserting the pressure rod may be alternatively provided in either the right or left side of the ink sack and ink cartridge case, respectively. However, in order to prevent accidental priming by the user, and the resulting dirtying of the printer and recording medium, when the ink jet cartridge is installed in an ink jet printer, the thick-wall region and through-hole for inserting the pressure rod are preferably provided on the bottom so that the priming operation cannot be accidentally executed.

An inkjet cartridge whereby an appropriate pressurization force can be obtained even when the remaining ink level is low, priming can therefore be reliably executed, there is no danger of the ink sack being punctured, and air bubbles and defective ink can be reliably and easily purged, can be provided by means of the embodiments described above because the thickness of the area pressed when pressurizing the ink sack is increased, a guide member is provided to reliably direct pressure to this thick-wall region, and the ink sack is given a flattened shape to assure uniform deformation of the ink sack.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An inkjet cartridge comprising:

a recording head having nozzles for ejecting ink in accordance with recording data received from a host processor;

an ink reservoir for accommodating recording ink and having an open end, a closed end, a thick-wall region and a thin-wall region, said ink reservoir being in communication with said recording head so that the ink stored in said ink reservoir is supplied to said nozzles;

a housing, wherein said ink reservoir and recording head are arranged in said housing;

a through-hole provided in a side of said housing disposed facing the thick wall region for accommodating an end of a pressure rod, the pressure rod for applying pressure to the thick-wall region of said ink reservoir; and a guide disposed around one of (1) the thick-wall region of said ink reservoir and (2) said through-hole for guiding the end of the pressure rod to the thick-wall region of said ink reservoir.

2. An inkjet cartridge according to claim 1, wherein a thickness of the thick-wall region of the ink reservoir is two to ten times that of the thin-wall region of said ink reservoir.

3. An inkjet cartridge according to claim 1, wherein the thick-wall region of said ink reservoir is provided in a bottom region of the ink reservoir and said through-hole is provided in a bottom region of said housing.

4. An inkjet cartridge according to claim 1, wherein the thick-wall region comprises an area in a range of approximately one-quarter to one-half a circumference of said ink reservoir.

5. An inkjet cartridge according to claim 1, further comprising a channel arranged around said nozzles for stopping a predetermined quantity of ink, which is expelled from said ink reservoir by pressure from the pressure rod.

6. An inkier cartridge according to claim 1, wherein said ink reservoir is arranged on a carriage, wherein the carriage moves along a first direction, wherein the open end of said ink reservoir has a first length along the first direction, wherein the open end of said ink reservoir has a second length along a second direction other than the first direction, and wherein the first length is greater than the second length.

7. An inkier cartridge according to claim 1, wherein the pressure rod is inserted through said through-hole in a first direction, wherein the open end of said ink reservoir has a first length along the first direction, wherein the open end of said ink reservoir has a second length along a second direction other than the first direction, and wherein the first length is smaller than the second length.

8. An inkjet printer comprising:

a reciprocating carriage; and an inkjet cartridge disposed on said carriage comprising:

a recording head having nozzles for ejecting ink in accordance with recording data received from a host processor, an ink reservoir for accommodating recording ink and having an open end, a closed end, a thick-wall region and a thin-wall region, said ink reservoir being in communication with said recording head so that the ink stored in said ink reservoir is supplied to said nozzles, wherein the carriage moves along a first direction, wherein the open end of said ink reservoir has a first length along the first direction, wherein the open end of said ink reservoir has a second length along a second direction other than the first direction, and wherein the first length is greater than the second length, a housing, wherein said ink reservoir and recording head are arranged in said housing, a through-hole provided in a side of said housing disposed facing the thick wall region for accommodating an end of a pressure rod for applying pressure to the thick-wall region of said ink reservoir, and a guide disposed around one of (1) the thick-wall region of said ink reservoir and (2) said through-hole for guiding the end of the pressure rod to the thick-wall region of said ink reservoir.

9. An inkjet printer comprising:

a reciprocating carriage; and an inkjet cartridge disposed on said carriage comprising:

a recording head having nozzles for ejecting ink in accordance with recording data received from a host processor, an ink reservoir for accommodating recording ink and having an open end, a closed end, a thick-wall region and a thin-wall region, said ink reservoir being in communication with said recording head so that the ink stored in said ink reservoir is supplied to said nozzles;

a housing, wherein said ink reservoir and recording head are arranged in said housing, a through-hole provided in a side of said housing disposed facing the thick wall region for accommodating an end of a pressure rod for applying pressure to the thick-wall region of said ink reservoir, wherein the pressure rod is inserted through said through-hole in a first direction, wherein the open end of said ink reservoir has a first length along the first direction, wherein the open end of said ink reservoir has a second length along a second direction other than the first direction, and wherein the first length is smaller than the second length, and a guide disposed around one of (1) the thick-wall region of said ink reservoir and (2) said through-hole for guiding the end of the pressure rod to the thick-wall region of said ink reservoir.

* * * * *

UNITED STATES PATENT AND TRADEMARK OFFICE

CERTIFICATE OF CORRECTION

PATENT NO. : 5,631,683

DATED : May 20, 1997

INVENTOR(S) : Atushi Nishioka, et al.

It is certified that errors appear in the above identified patent and that said Letters Patent is hereby corrected as shown below:

Column 9, line 47, change "inkier" to --inkjet--.

Column 9, line 56, change "inkier" to --inkjet--.

Signed and Sealed this

Fifth Day of August, 1997

Bruce Lehman

*Attest:*

BRUCE LEHMAN

*Attesting Officer*

*Commissioner of Patents and Trademarks*